US008162721B2

(12) United States Patent
Kitatsuji et al.

(10) Patent No.: US 8,162,721 B2
(45) Date of Patent: Apr. 24, 2012

(54) SURFACE GRINDING MACHINE, SPINDLE DEVICE AND SURFACE GRINDING METHOD

(75) Inventors: Hideto Kitatsuji, Yao (JP); Tomohiro Okamoto, Yao (JP)

(73) Assignee: Koyo Machine Industries Co., Ltd., Osaka (JP)

( * ) Notice: Subject to any disclaimer, the term of this patent is extended or adjusted under 35 U.S.C. 154(b) by 983 days.

(21) Appl. No.: 12/157,467

(22) Filed: Jun. 11, 2008

(65) Prior Publication Data

US 2008/0305724 A1 Dec. 11, 2008

(30) Foreign Application Priority Data

Jun. 11, 2007 (JP) ..... 2007-153703

(51) Int. Cl.
*B24B 1/00* (2006.01)

(52) U.S. Cl. ..... 451/11; 451/411; 451/264

(58) Field of Classification Search ..... 451/11, 451/262, 264, 41
See application file for complete search history.

(56) References Cited

U.S. PATENT DOCUMENTS 1,906,731 A * 5/1933 Wuerfel ..... 451/28
3,435,563 A * 4/1969 Reaser ..... 451/239
3,537,214 A * 11/1970 Ford ..... 451/264
4,462,187 A * 7/1984 Dunn ..... 451/262
4,782,631 A * 11/1988 Nishio ..... 451/262
4,894,957 A * 1/1990 Loladze et al. ..... 451/285
4,901,477 A * 2/1990 Loladze et al. ..... 451/259
5,967,882 A * 10/1999 Duescher ..... 451/57
5,989,108 A * 11/1999 Ikeda et al. ..... 451/268
6,652,358 B1 * 11/2003 Ikeda et al. ..... 451/8

FOREIGN PATENT DOCUMENTS

JP 5-008161 1/1993
JP 2005-329522 12/2005

* cited by examiner

*Primary Examiner* — Maurina Rachuba
(74) *Attorney, Agent, or Firm* — Jordan and Hamburg LLP

(57) ABSTRACT

In through-feed grinding workpieces by grinding stones rotating around the axes of spindles, the spindles are tiltably held by elastic holding means around tilt axes substantially orthogonal to the direction of exit and entrance of the workpieces with respect to the grinding stones. When a grinding loads are imposed on the entrance sides of the grinding stones, the spindles are tilted by offset loads around the tilt axes against the force of urging means in such a manner that the axial displacement and the exit displacement of the grinding stone due to the offset load are substantially the same. The grinding stones are reset around the tilt axes by the elastic holding means immediately before the end of processing at which time the axial displacement is smaller. This makes it possible to reduce the number of defectively ground articles coming from the through-feed grinding and reduce the wear in the grinding stones.

14 Claims, 8 Drawing Sheets

【Fig. 1】
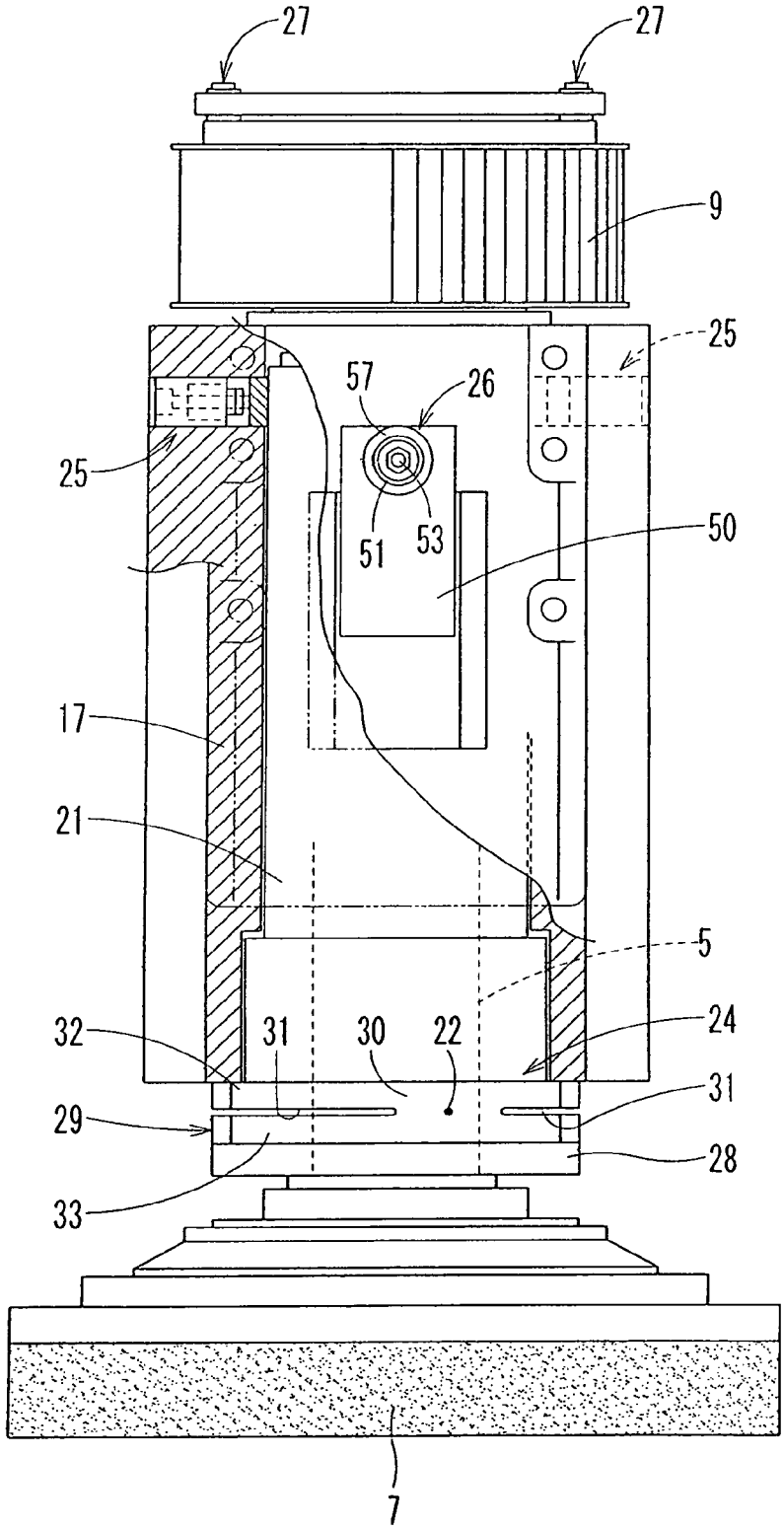

【Fig. 2】
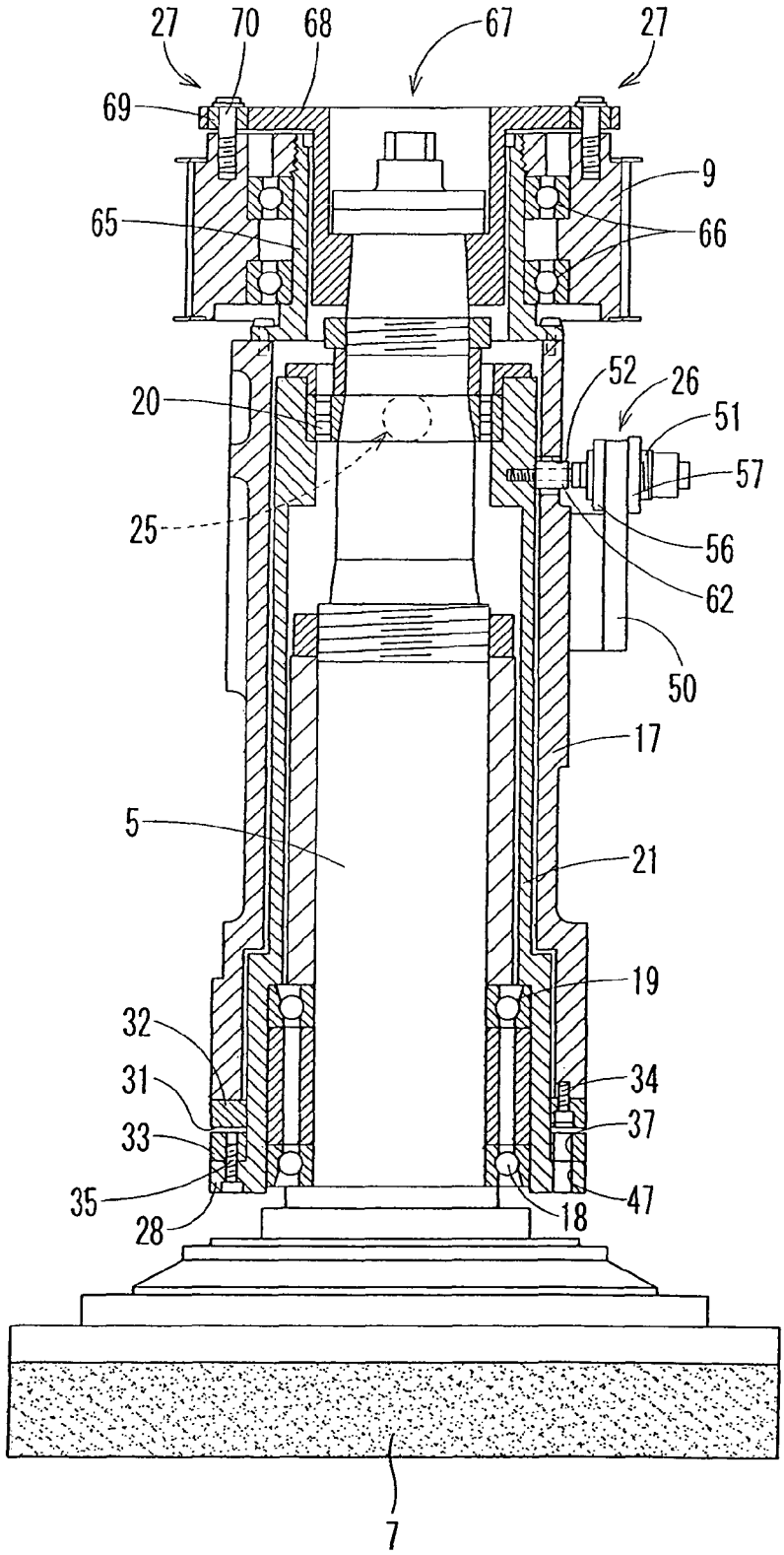

【Fig. 3】
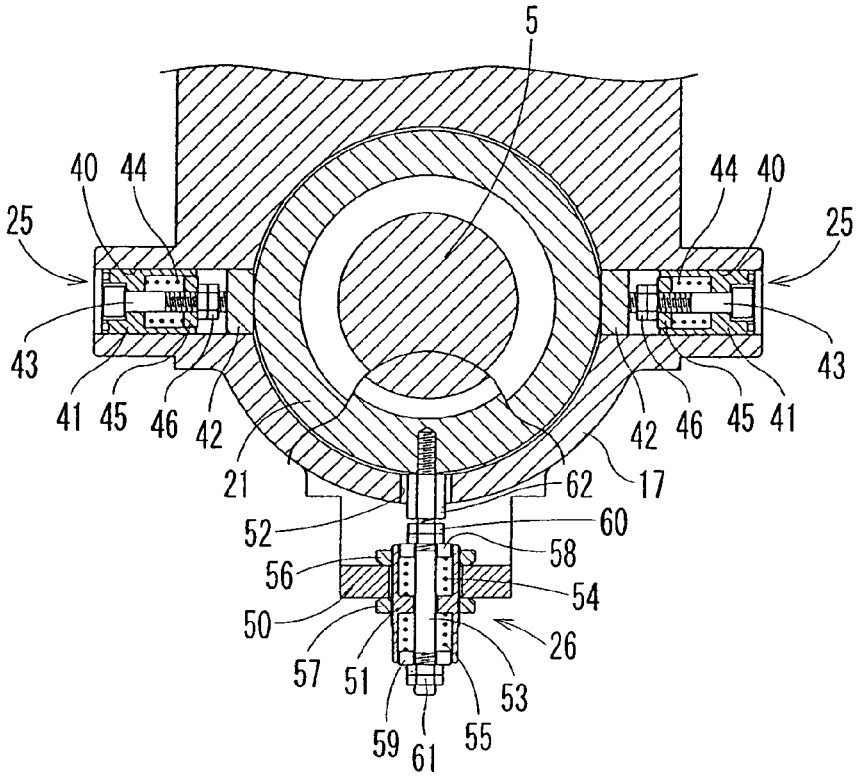
【Fig. 4】
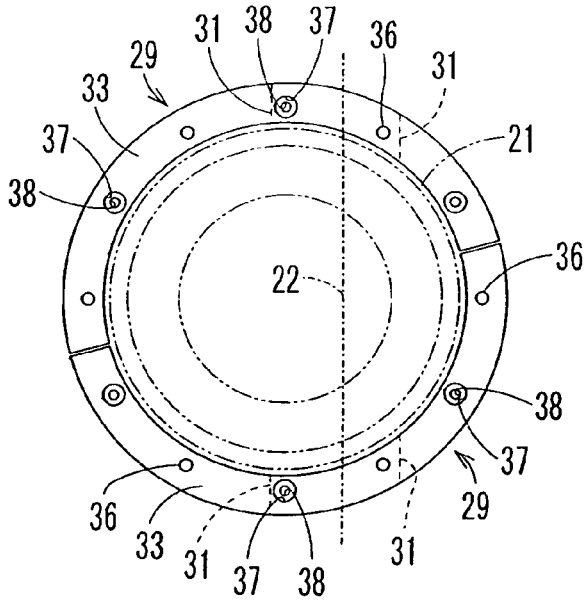

【Fig. 5】
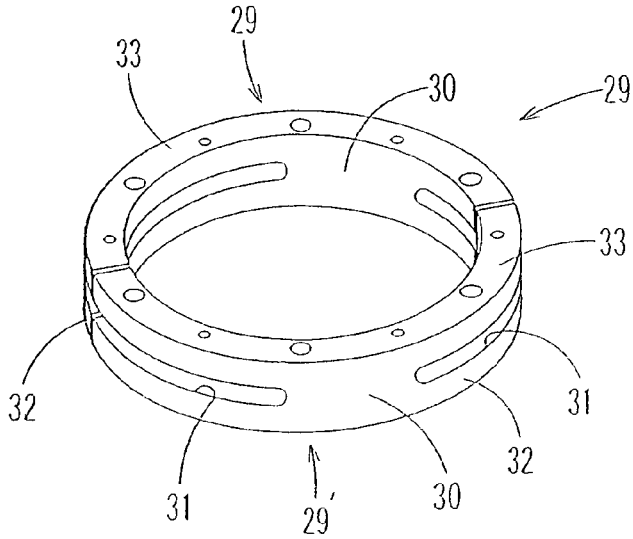
【Fig. 6】
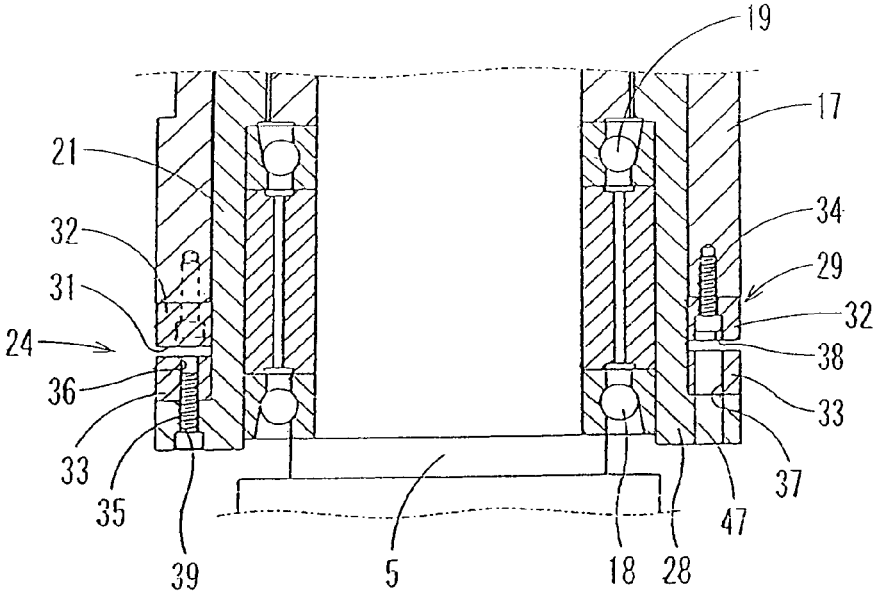

【Fig. 7】
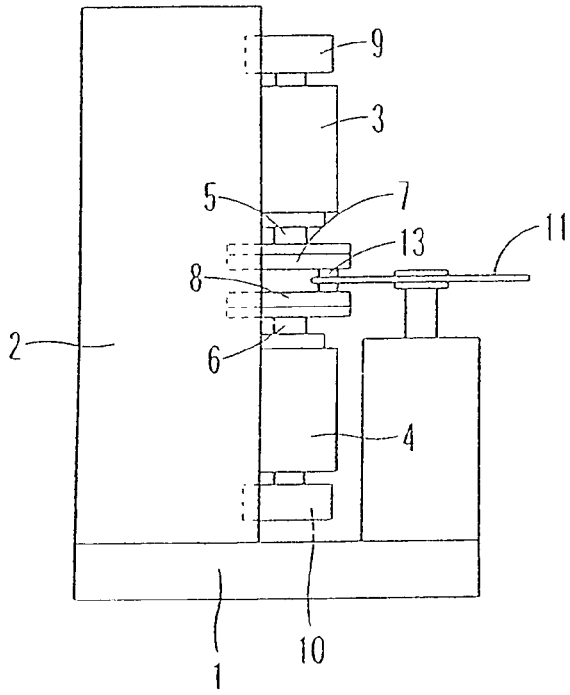
【Fig. 8】
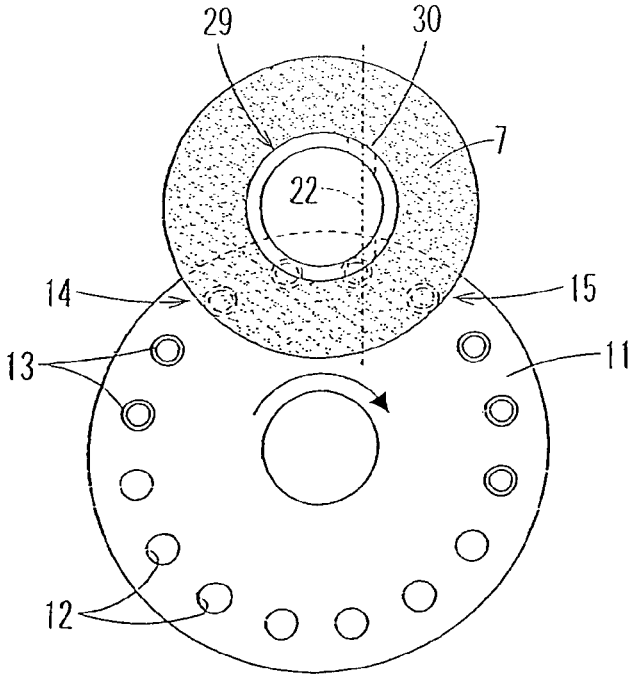

【Fig. 9】
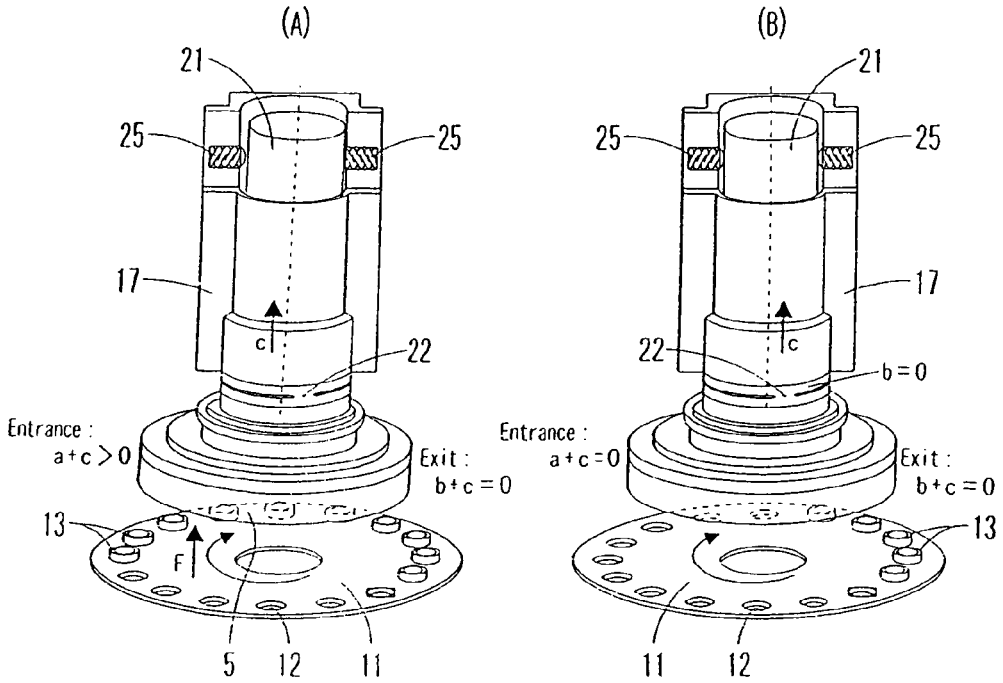
【Fig. 10】
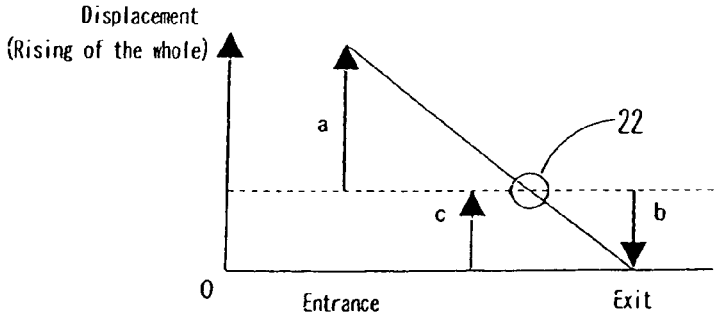

【Fig. 13】
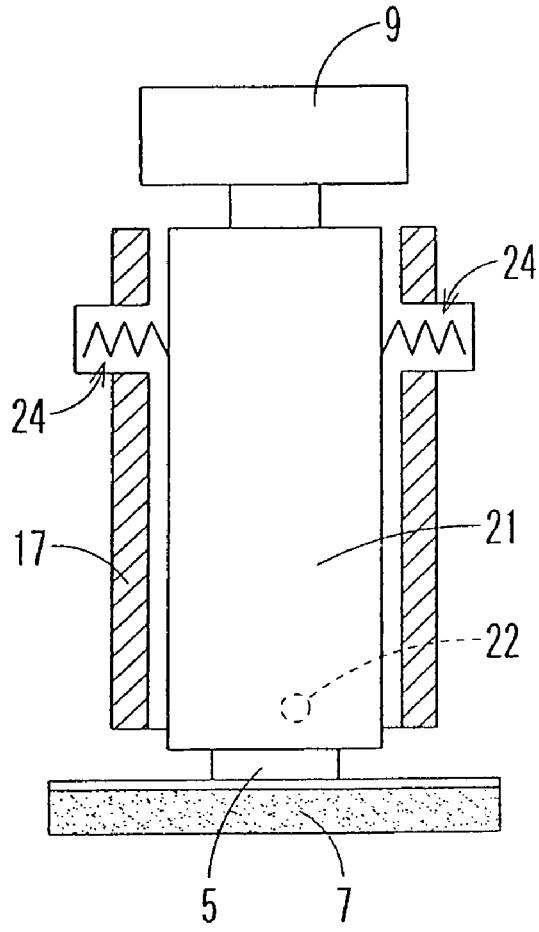

SURFACE GRINDING MACHINE, SPINDLE DEVICE AND SURFACE GRINDING METHOD

BACKGROUND OF THE INVENTION

The present invention relates to a surface grinding machine and a surface grinding method for through-feed grinding workpieces by the through-feed grinding method, adapted to reduce the number of defectively ground articles produced during the through-feed grinding and to reduce wear in grinding stones.

Concerning two-sided surface grinding machines for surface-grinding workpieces by the through-feed grinding method, many techniques have already been proposed, including Patent Document 1 (Japanese Patent Laid-Open No. Hei 5-8161), and Patent Document 2 (Japanese Patent Laid-Open No. 2005-329522). Such two-sided surface grinding machine is adapted to simultaneously grind the opposite surfaces of workpieces, by the through-feed grinding method, held by a carrier and received in pockets circumferentially formed in said carrier by feeding said workpieces between a pair of grinding stones rotating around the axes of spindles.

Concerning devices for simultaneously finish-grinding the opposite surfaces of workpieces, there is one in which, as in the invention disclosed in Patent Document 3 (Japanese Utility Model Laid-Open No. 63-124461), for example, on the front ends of a pair of coaxially disposed spindles are mounted opposed grinding stones floatably in all directions, said pair of grinding stones simultaneously finish-grinding the opposite surfaces of workpieces.

As for two-sided surface grinding machines, they have heretofore been provided with various measures for securing the rigidity of the spindle units including spindles, the main frame, and the like so as to sufficiently withstand the grinding loads during the workpiece grinding. However, it is impossible to fully prevent the axial displacements, in the escape direction, of the grinding stones caused by the grinding loads.

Thus, analyzing the through-feed grinding state reveals that during the continuous processing of workpieces, the grinding load is so heavy as to produce given axial displacements, in escape direction, of the grinding stones, but immediately before the end of the continuous processing, the grinding loads so sharply decrease that the axial displacements disappear. Therefore, depending on the presence or absence of such axial displacement, the spacing between the pair of grinding stones makes a delicate change on the exit side of workpieces, so that the thickness of the workpieces processed in the last stage tends to be small.

Further, in the device described in Patent Document 3, the grinding stones tilt in all directions but the grinding stones only follow the surfaces to be ground of the workpieces. Therefore, even if the techniques shown in Patent Document 3 are applied to a two-sided surface grinding machine, the front ends of the grinding stones follow the workpieces only to float, and a reduction in the number of defectively ground articles produced by the through-feed grinding or improvements in the precision of workpiece processing cannot be expected.

In view of these problems in prior art, an object of the invention is to provide a surface grinding machine, a spindle device, and a surface grinding method capable of reducing the number of defectively ground articles produced by the through-feed grinding and capable of reducing wear in grinding stones.

SUMMARY OF THE INVENTION

A surface grinding machine according to the invention for through-feed grinding workpieces by grinding stones rotating around the axes of spindles, is characterized by comprising elastic holding means for holding the grinding stones tiltably around tilt axes crossing the direction of exit and entrance of said workpieces with respect to the grinding stones, said tilt axes being set in such a position that when the grinding stones are tilted against the force of the elastic holding means by offset loads produced by grinding loads on the entrance sides of the grinding stones to thereby produce entrance displacements and reverse exit displacements in the grinding stones in the escape direction, the axial displacements and exit displacements of the grinding stones due to said offset loads are substantially the same.

Further, a spindle device according to another form of the invention is characterized by comprising an inner case rotatably holding a spindle having a grinding stone fixed thereto, a spindle case having said inner case fitted therein with a predetermined clearance defined therebetween, elastic holding means for tiltably holding said grinding stone around a tilt axis crossing the direction of exit and entrance of workpieces with respect to said grinding stone, said elastic holding means being installed between said spindle case and said inner case, said tilt axes being set in such a position that when the grinding stones are tilted against the force of the elastic holding means by offset loads produced by grinding loads on the entrance sides of the grinding stones to thereby produce entrance displacements and reverse exit displacements in the grinding stones in the escape direction, the axial displacements and exit displacements of the grinding stones due to said offset loads are substantially the same.

Further, a surface grinding method according to another form of the invention for through-feed grinding workpieces by grinding stones rotating around the axes of spindles, is characterized by comprising the steps of holding said spindles by elastic holding means so as to allow them to tilt around tilt axes substantially orthogonal to the direction of exit and entrance of said workpieces with respect to the grinding stones, wherein when grinding loads are imposed on the entrance sides of the grinding stones, said spindles are tilted around the tilt axes against the forces of said elastic holding means by offset loads in such a manner that the axial displacements and exit displacements of said grinding stones due to said offset loads are substantially the same, said grinding stones being reset around said tilt axes by said elastic holding means immediately before the end of processing at which time said axial displacement is smaller.

According to the invention described so far, both during the continuous processing and immediately before the end of processing, the exit displacements of the grinding stones are constant, so that the number of defectively ground articles produced during the through-feed grinding can be reduced, and moreover, there is another advantage that the entrance displacements of the grinding stones in the escape direction make it possible to reduce wear in the grinding stones.

BRIEF DESCRIPTION OF THE DRAWINGS

FIG. 1 is a partly broken front view of an upper spindle unit, showing a first embodiment of the invention;

FIG. 2 is a longitudinal sectional view of the upper spindle unit;

FIG. 3 is a cross sectional view of the upper spindle unit;

FIG. 4 is a bottom view of an elastic spacer;

FIG. 5 is a perspective view of the elastic spacer taken on the bottom side;

FIG. 6 is a principal enlarged sectional view of the upper spindle unit;

FIG. 7 is a schematic view of a vertical type two-sided surface grinding machine;

FIG. 8 is a view explanatory of a grinding state;

FIG. 9 is a view explanatory of a grinding state;

FIG. 10 is a view explanatory of a tilt axis position;

FIG. 13 is a longitudinal sectional view, showing a fourth embodiment of the invention.

DETAILED DESCRIPTION OF THE INVENTION

Figure 11A:
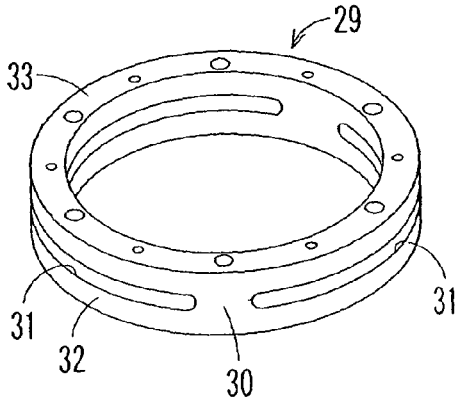
FIG. 11 (A)-(B) are perspective views, showing a second embodiment of the invention.

Embodiments of the invention will be described with reference to the drawings. FIGS. 1-10 show by way of example a first embodiment of the invention embodied in a vertical type two-sided surface grinding machine. This vertical type two-sided surface grinding machine, as shown in FIG. 7, includes a base 1, a main frame 2 fixed on the base 1, and a pair of upper and lower spindle units 3 and 4 disposed in front of the main frame 2, the spindle units 3 and 4 having grinding stones 7 and 8 mounted thereon, in vertically opposed relation to each other, for rotation around the axes of spindles 5 and 6.

The upper spindle unit 3, which is of an elasticity variable type, is disposed liftably with respect to the main frame 2. The spindles 5 and 6 are driven by drive sources on the main frame 2 through belts or other wrapping connector means. In addition, the lower spindle unit 4 is also liftable with respect to the main frame 2.

A carrier 11 is disposed between the upper and lower grinding stones 7 and 8. The carrier 11, as shown in FIG. 8, has a plurality of pockets 12 substantially equispacedly disposed substantially on the same circumference, the arrangement being such that during the through-feed grinding, workpieces 13 held in the pockets 12 are fed from the entrance 14 to the exit 15.

The upper spindle unit 13, as shown in FIGS. 1-3, includes a spindle case 17 vertically movably supported on the main frame 2 through suitable means, the spindle 5 having the grinding stone 7 removably attached to the lower end thereof, an inner case 21 rotatably holding the spindle 5 through a plurality of stacked bearings 18-20 and fitted in a spindle case 17 with a predetermined clearance defined therebetween throughout the circumference, elastic holding means 24 disposed in the vicinity of the upper side of the grinding stone 7 and tiltably holding the inner case 21 around a tilt axis 22 substantially orthogonal (for example, in the front-rear direction) to the direction of exit and entrance connecting the entrance 14 and exit 15 (for example, in the left-right direction), rigidity adjusting means 25 disposed on opposite sides of the direction of exit and entrance between the spindle case 17 and the inner case 21 and used for the adjustment of the rigidity of the elastic holding means 24, center holding means 26 for elastically holding the inner case 21 substantially at the axial (front-rear) center of the tilt axis 22 with respect to the spindle case 17, and flexible couplings 27 interposed between the spindle 5 and a pulley 9 disposed on the upper end of the spindle 5.

The inner case 21 has a flange 28 at the lower end, with the elastic holding means 24 interposed axially of the spindle 5 and between the upper surface of the flange 28 and the lower end surface of the spindle case 17. The elastic holding means 24 has a peripheral elastic spacer 29 disposed substantially concentric with the spindle case 17 and with the inner case 21.

The elastic spacer 29, as shown in FIGS. 4 and 5 also, is peripherally divided into two (plurality) spacer segments 29' so as to be mounted and dismounted from the outer periphery, the two elastic spacer segments 29' being annularly disposed as a whole to surround the inner case 21.

Except in a tilt axis corresponding sections 30 corresponding to the tilt axis 22, the elastic spacer 29 is formed with peripheral slots 31 on opposite sides of the entrance 14 and exit 15 with respect to the tilt axis 22. Therefore, the tilt axis corresponding sections 30 are rigid and on opposite sides thereof the upper and lower edges 32 and 33 vertically elastically deform, allowing the slits 31 to expand and contract.

The upper and lower edges 32 and 33 of each elastic spacer segment 29', as shown in FIG. 6, are removably fixed to the spindle case 17 and to the flange 28 of the inner case 21 by bolts (fasteners) 34 and 35 inserted from below.

In other words, the lower edge 33 of the elastic spacer 29 is peripherally substantially equispacedly alternately formed with threaded holes 36 and insertion holes 37, while the upper edge 32 is formed with attaching holes 38 in association with the insertion holes 37. The flange 38 is peripherally alternately formed with attaching holes 29 corresponding to the threaded holes 36 in the lower edge 33 and insertion holes 47 corresponding to the insertion holes 37.

And, the upper edge 32 is fixed from below to the spindle case 17 by bolts 34 inserted through the insertion holes 37 and 47 into the attaching holes 38, while the lower edge 33 is fixed from below to the flange 28 of the inner case 21 by the bolts 35 inserted through the attaching holes 39 and screwed into the threaded holes 36.

Thus, the elastic spacer 29 is fixed to the spindle case 17 with a clearance defined between the flange 28 of the inner case 21 and the spindle case 17, and then the inner case 21 is inserted in the spindle case 17 and the elastic spacer 29 is fixed to the inner case 21, whereby, coupled with the fact that the elastic spacer 29 is divided into two spacer segments 29', the elastic spacer 29 can be easily mounted and dismounted.

The rigidity adjusting means 25 are disposed in a pair on the upper end of the spindle case 17 and in opposed relation to each other in the direction of exit and entrance. Each rigidity adjusting means 25, as shown in FIG. 3, includes a spindle case 41 screwed into a threaded hole 40 in the spindle case 17 for advance and retraction in the direction of exit and entrance, a machine bolt 43 inserted in the spring case 41 in the direction of exit and entrance and abutting against the inner case 21 through a shim 42, and an rigidity adjusting spring 44 disposed in the spring case 41 and urging the machine bolt 43 toward the inner case 21.

And, each rigidity adjusting means 25 is capable of disposing the spindle 25 substantially at the middle by advancing and retracting the spring case 41 in the direction of exit and entrance and is capable of auxiliary adjusting the elasticity (rigidity) of the elastic spacer 29 by replacing the rigidity adjusting spring 44 by one different in spring constant.

In addition, the rigidity adjusting spring 44 is adapted to urge the machine bolt 43 through a spring shoe 45, and a double nut arrangement 46, so that its spring pressure can be adjusted by turning the double nut arrangement 46. Further, the rigidity adjusting spring 44 may be a coil spring or a Belleville spring. Rigidity adjusting means 25 is adapted to have the spring case 41 removably attached thereto from outside, allowing the rigidity adjusting spring 44 to be replaced outside the spindle unit 3.

The center holding means 26 is disposed in the front-rear direction in the vicinity of the lower side of the rigidity adjusting means 25, substantially in association with an upper bearing 20 and between the inner case 21 and the bracket 50 of the spindle case 17. And, the center adjusting means 26, as shown in FIG. 3, includes a spring case 51 fixed to the bracket 50 for positional adjustment in the front-rear direction, a push-pull bolt 53 inserted in the spring case 51 and extending through a hole 52 in the spindle case 17 and screwed into the inner case 21, and a pair of holding springs 54 and 55 disposed on opposite sides of the intermediate wall in the spring case 51 and urging the inner case 21 in the front-rear direction through the push-pull bolt 53. In addition, the position where the center holding means 26 is attached has only to be in the vicinity of the height of the rigidity adjusting means 25, not limited to the position corresponding to the bearing 20.

The spring case 51 is positionally adjustable in the front-rear direction by nuts 56 and 57 screwed into the outer periphery on opposite sides of the bracket 54. Further, the holding springs 54 and 55 are adapted to urge the push-pull bolt 53 in the front-rear direction through spring shoes 58 and 59, and double nut arrangements 60 and 61, the arrangement being such that the spring pressures of the holding springs 54 and 55 can be adjusted by turning the double nut arrangements 60 and 61. The push-pull bolt 53 has a lock nut 62 screwed thereon within the hole 52 in the spindle case 17. The holding springs 54 and 55 may be a coil spring or a Belleville spring.

On the upper end of the spindle case 17 is mounted a cylindrical fixed shaft 65, and on the outer periphery of the fixed shaft 65 is fixed the pulley 9 through bearings 66. On the upper end of the spindle 5 is fixed a transmission flange 67 disposed inside the fixed shaft 65. The transmission flange 67 has a flange 68 corresponding to the upper side of the pulley 9, said flange 68 being connected to the pulley 9 through the plurality of peripherally disposed flexible couplings 27.

The flexible coupling 27 has an elastic body 69 fitted in the flange 68, and a bolt 70 extending through the elastic body 69 and fixed to the pulley 9. Therefore, even if the grinding load tilts the spindle 5 around a tilt axis 20, power can be transmitted from the pulley 9 through the flexible coupling 27 and the transmission flange 67 to the spindle 5.

In through-feed grinding the workpieces 13 by the two-sided surface grinding machine of the above arrangement, the pair of grinding stones 7 and 8 rotating around the axes of the spindles 5 and 6 grind the opposite surfaces of the workpieces 13 while continuously feeding the workpiece 13 held by the carrier 11 into between the pair of upper and lower grinding stones 7 and 8.

In this case, when the grinding load acts on the entrance 14 side of the grinding stone 7 during the continuous grinding of the workpieces 13 or the like operation, as shown in FIG. 9 (A), the offset load F raises the upper spindle unit 3 to produce an axial displacement c in the escape direction of the grinding stone 7, while the inner case 21 and spindle 5 tilt around the axis 22 against the force of the elastic holding means 24 and the force of the rigidity adjusting means 25, thus an entrance displacement a and an exit displacement b are produced in the grinding stone 7 in the entrance direction and reverse exit direction, respectively. And, immediately before the end of the continuous processing, the grinding load sharply decreases to approach almost zero, so that as shown in FIG. 9 (B), the inner case 21 and spindle 25 are urged by the elastic holding means 24 and rigidity adjusting means 25 to be reset around the tilt axis 20.

Concerning the positioning of the tilt axis 22, a position in which the axial displacement c of the grinding stone 7 is substantially the same as the exit displacement b of the grinding stone 7 on the exit 15 side is calculated by the following method, and the tilt axis is set at said calculated position; therefore, whether during the continuous processing of the workpieces 13 or immediately before the end of the continuous processing, the displacement of the exit of the grinding stones 7 and 8 can be kept zero at all times, reducing the number of defectively ground articles.

That is, the upper spindle unit 3 is of the rigidity variable type in which the inner case 21 is capable of tilting inside the spindle case 17 against the force of the rigidity adjusting means 25; thus, in the case where the grinding load from the workpieces 13 is applied to the grinding stone 7 on the entrance 14 side, the offset load F produces the entrance displacement a which is a displacement in the upward direction (escape direction) on the entrance 14 side, the exit displacement b which is a displacement in the processing direction on the exit 15 side, and the axial displacement c which is a displacement in the upward direction of the whole including the spindle units 3 and 4 (see FIG. 9 (A)).

The axial displacement c, which is obtained by calculation or actual measurement, is a value intrinsic in the grinding machine and determined by the rigidity of the main frame 2 or the like. Further, the entrance displacement a is determined by finding an optimum displacement from experimental data with consideration given to grinding performance and to damage given to the grinding stone 7. And, as shown in FIG. 10, the position of the tilt axis 20 where the axial displacement c and the exit displacement b coincide is determined, in harmony with which the shape and construction of the elastic spacer 29 is determined.

With the arrangement thus made, the entrance displacement a, exit displacement b, and axial displacement c are proportional to the magnitude of the grinding load, so that even if the grinding load varies, the exit displacement b can be maintained at zero. For example, during the continuous processing of the workpieces 13, the axial displacement $c>0$, and exit displacement $b<0$. However, since the tilt axis 22 is so set that exit displacement b=axial displacement c, $a+c>0$ at the entrance 14 of the grinding stone 7, but $b+c=0$ at the exit 15 of the grinding stone 7 (see FIG. 9 (A)).

Further, immediately before the end of the continuous processing of the workpieces 13, the grinding load approaches zero, so that the axial displacement c of the grinding stone 7 is zero and the inner case 21 and the spindles 5 and 6 are reset around the tilt axis 22 by the elastic holding means 24 and rigidity adjusting means 25 until exit displacement $b=0$, and $b+c=0$ at the exit 15 of the grinding stone 7 (see FIG. 9 (B)).

Therefore, as shown in FIGS. 9 (A) and (B), since there is no difference in displacement on the exit 15 side of the grinding stone 7 between the period of continuous processing and the point of time immediately before the end of continuous processing, the number of defectively ground workpieces 13 can be greatly reduced.

Further, during the through-feed grinding of the workpieces 13, since the entrance displacement a is produced on the entrance 14 side of the grinding stone 7 except immediately before the end of the continuous processing (see FIG. (A)), damage to the grinding stones 7 and 8 is reduced in that the entrance 14 side of the grinding stone 7 escapes upward; thus, reduction of wear in the grinding stone 7 can be achieved.

Furthermore, structurally, the lower end of the inner case 21 is supported at the lower end of the spindle case 17 through the elastic spacer 29 having the tilt axis corresponding section 30 between the slits 31, and the position of the tilt axis 22 is determined by the shape and structure of the elastic spacer 29; therefore, the lower ends of the inner cases 21, that is, the lower ends of the spindles 5 and 6 can be stably supported and the position of the tilt axis 22 is substantially constant and stabilized; furthermore, the arrangement can structurally be simply made.

Further, the elastic spacer 29 is of split construction, wherein the upper edges 32 and lower edges 33 above and below the slits 31 are removably fixed to the spindle case 17 and inner case 21 by bolts from below, eliminating the need to disassemble the entire spindle unit 3 unlike the case of using a solid annular elastic spacer; the split elastic spacer 29 can be easily mounted and dismounted by partial disassembly.

Further, separate from the elastic spacer 29 of the elastic holding means 24, the pair of rigidity adjusting means 25 are installed in the upper region in opposed relation to each other in the direction of exit and entrance, making it possible to make various adjustments. For example, while the rigidity (elasticity) of the split elastic space 29 is constant, the rigidity with which the assembly tilts around the tilt axis 22 can be suitably adjusted, or can be increased or decreased by the rigidity adjusting means 25.

Further, the rigidity (elasticity) of the elastic spacer 29 is found by computer-assisted FEM analysis, and even when a calculated value differs from an actual value, the difference therebetween can be corrected by making rigidity adjustment by the rigidity adjusting means 25. Further, the value of the entrance displacement a varies with the kind of the workpieces 13 and the grinding stones 7 and 8 to be used; in this case also, optimum grinding is made possible by making rigidity adjustment by the rigidity adjusting means 25.

The spring rigidity (spring constant) of the rigidity adjusting means 25 cannot be adjusted. However, using springs different in spring constant for the rigidity adjusting means 25 makes it possible to make such adjustment. In this case also, since the rigidity adjusting means 25 can be disassembled and assembled from outside, such replacement of springs can be easily made from outside.

While the upper side of the inner case 21 is supported with respect to the spindle case 17 through the pair of rigidity adjusting means 25 extending in the direction of exit and entrance, the center holding means 26 exists between the spindle case 17 and the inner case 21. Since the center holding means 26 allows the front-rear centers of the two members to substantially coincide with each other, in spite of the inner case 21 tilting inside the spindle case 17 around the tilt axis 22, front-rear oscillation or the like of the inner case 21 can be easily prevented.

Figure 11B:
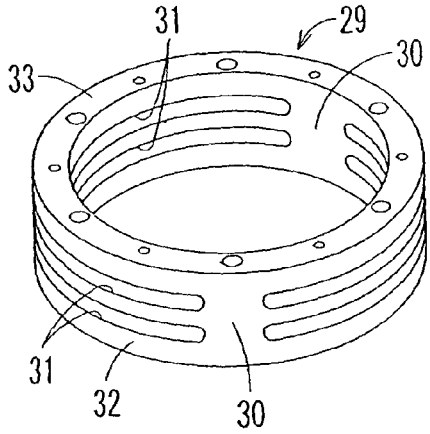

FIG. 11 shows by way of example a second embodiment of the invention. An elastic spacer 29, as shown in FIG. 11 (A), may be annularly constructed, or as shown in FIG. 11 (B), it may be one axially provided with a plurality of slots 31.

In addition, the elastic space 29 may has its slits 31 replaced by a number of radially extending circular, elongated or otherwise shaped holes formed except in tilt axis corresponding sections 30, or by a number of upper and lower recesses different in peripheral position.

Thus, it is only necessary that the elastic spacer 29 be constructed such that opposite sides of the tilt axis corresponding sections 30 are capable of elastic deformation in a direction in which the inner case 21 tilts around the tilt axis 22; therefore, the elastic spacer 29 is not limited to the construction and shape shown by way of example in the first embodiment. Further, the position of the tilt axis 22, elasticity (rigidity) and the like of the elastic spacer 29 may be suitably changed according to the grinding conditions or the like of workpieces 13.

Figure 12A:
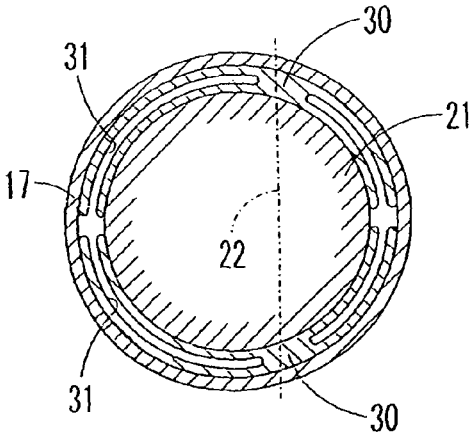
FIG. 12 (A) is a cross sectional view, showing a third embodiment of the invention, and (B) is an enlarged view of the same.
Figure 12B:
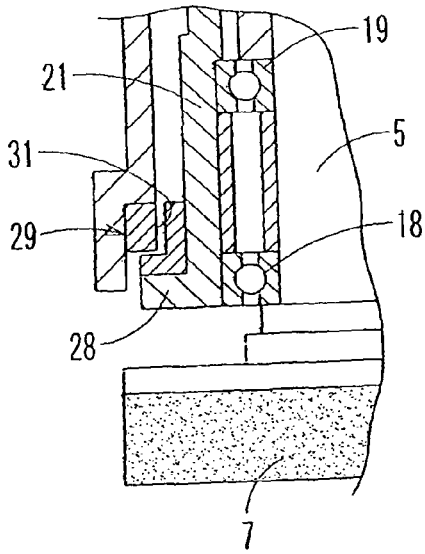

FIG. 12 shows by way of example a third embodiment of the invention. An elastic spacer 29 having tilt axis corresponding sections 30, as shown in FIGS. (A) and (B), may be formed with peripheral slits 31 in a radially intermediate position, and may be diametrically installed between the spindle case 17 and inner case 21.

FIG. 13 shows by way of example a fourth embodiment of the invention. The inner case 21 is tiltably connected at the lower end to the spindle case 17 by a pivot 22. And, the upper side of the spindle case 17 is provided with elastic holding means 34 on opposite sides of the direction of exit and entrance for tiltably holding the inner case 21. In addition, the elastic holding means 24 are capable of adjustment of spring pressure.

In this manner, even if the inner case 21 is pivotally connected to the spindle case 17 by the real pivot 22, the invention can be likewise embodied by determining the position of the pivot 22 in the same manner as in the case of the tilt axis in the first embodiment. Therefore, the relation between the elastic holding means 24 and the tilt axis can be changed in various ways including the use of the elastic spacer 29 shown in the first embodiment.

Embodiments of the invention have been described so far, but the invention is not limited thereto and various modifications can be made without departing from the spirit of the invention. For example, although the embodiments have shown a vertical type two-sided surface grinding machine, the invention can also be embodied in a horizontal type two-sided surface grinding machine. Further, the rigidity variable spindle unit 3 in the embodiments may, besides an opposed two-axis type, be a single axis type.

The elastic spacer 29 of the elastic holding means 24, normally, is one such that the upper surface of the upper edge 32 and the lower surface of the lower edge 33 are parallel in their free state. However, the arrangement may be such that with the elastic spacer 29 incorporated between the spindle case 17 and the inner case 21, the spindle case 17 and inner case 21 are urged toward and away from each other on opposite sides of the tilt axis 22.

Further, although the rigidity adjusting means 25 has been shown as one of spring type having the rigidity adjusting spring 44, use may be made of other elastic body such as rubber, and it is also possible to use compressible fluid pressure cylinders such as air cylinders. The same can be said of the elastic holding means 24. Further, in the case of using the elastic spacers 29 as the elastic holding means 24, the position of the tilt axis 22 can be optionally changed by changing the number, length, and direction of the spacers.

In the first embodiment, rigidity adjusting means 25 have been disposed substantially symmetrically on opposite sides of the direction of exit and entrance. However, such rigidity adjusting means 25 may be disposed on one side alone to which the grinding load tilts the inner case 21. Further, it may be arranged that the inner case 21 be tilted around the tilt axis by the spindle case 17 or other guide means. In that case, the center holding means 26 can be omitted.

There are many types of springs, and any type of springs including Belleville springs and coil springs may be used for the rigidity adjusting springs 44, and holding springs 54 and 55.

What is claimed is:

1. A surface grinding machine for through-feed grinding workpieces by grinding stones rotating around the axes of spindles, said surface grinding machine comprising elastic holding means for holding the grinding stones tiltably around a tilt axis, wherein an entrance of said workpieces occurs to one side of said tilt axis and an exit of said workpieces occurs to another side of said tilt axis with respect to the grinding stones, said tilt axis being in such a position that when the grinding stones tilt against the force of the elastic holding means due to grinding loads generated on the entrance sides of the grinding stones that produce an axial displacement of the grinding stones tilt axis in an escape direction, a responsive entrance displacement and a responsive exit displacement occur in the grinding stones, respectively at entrance and exit of the workpieces, wherein during said axial displacement the axial displacement and exit displacement are of approximately a same magnitude and opposite direction.

2. A surface grinding machine for through-feed grinding workpieces by grinding stones rotating around the axes of spindles, said surface grinding machine comprising:

elastic holding means for holding the grinding stones tiltably around tilt axes crossing a direction of exit and entrance of said workpieces with respect to the grinding stones, said tilt axes being set in such a position that when the grinding stones are tilted against the force of the elastic holding means by offset loads produced by grinding loads on the entrance sides of the grinding stones to thereby produce entrance displacements and reverse exit displacements in the grinding stones in the escape direction, the axial displacements and exit displacements of the grinding stones due to said offset loads are substantially the same; and an inner case rotatably holding said spindle having said grinding stone fixed thereto and a spindle case, the inner case being fitted in the spindle case with a predetermined clearance defined therebetween, said elastic holding means being disposed between said spindle case and said inner case.

3. A surface grinding machine as set forth in claim 2, wherein in the vicinity of said grinding stone, said elastic holding means is substantially coaxially provided with an elastic spacer axially interposed between said spindle case and said inner case, said elastic spacer being peripherally formed with respective slots coinciding with the entrance side and exit side of said grinding stone, a space between the slots defining said tilt axis.

4. A surface grinding machine as set forth in claim 3, wherein said elastic spacer is peripherally divided into a plurality of segments so as to be mounted and dismounted from the outer periphery.

5. A surface grinding machine as set forth in any of claims 2-4, further comprising, situated between said spindle case and said inner case on opposite sides thereof relative to said direction of entrance and exit of said workpieces, rigidity adjusting means for adjusting rigidity of said spindle case and said inner case.

6. A surface grinding machine as set forth in claim 5, further comprising center holding means for elastically holding said inner case substantially at the axial center of said tilt axis with respect said spindle case.

7. A spindle device comprising an inner case rotatably holding a spindle having a grinding stone fixed thereto, a spindle case having said inner case fitted therein with a predetermined clearance defined therebetween, elastic holding means for tiltably holding said grinding stone around a tilt axis crossing the direction of exit and entrance of workpieces with respect to said grinding stone, said elastic holding means being installed between said spindle case and said inner case, said tilt axes being set in such a position that when the grinding stones are tilted against the force of the elastic holding means by offset loads produced by grinding loads on the entrance sides of the grinding stones to thereby produce entrance displacements and reverse exit displacements in the grinding stones in the escape direction, the axial displacements and exit displacements of the grinding stones due to said offset loads are substantially the same.

8. A surface grinding method comprising the steps of:

through-feeding workpieces between and entrance and an exit to receive grinding from grinding stones that rotate around axes of spindles;

holding said spindles by elastic holding means so as to allow them to tilt around a tilt axis substantially orthogonal to a direction of exit and entrance of said workpieces with respect to the grinding stones, imposing grinding loads on the entrance sides of the grinding stones that cause said spindles to tilt around the tilt axes against the forces of said elastic holding means, during which is produced an axial displacement of the grinding stones tilt axis in an escape direction, and responsive to the axial displacement, producing an entrance displacement and an exit displacement in the grinding stones, respectively at entrance and exit of the workpieces, wherein during said axial displacement the axial displacement and exit displacement of said grinding stones are of approximately a same magnitude and opposite direction, as said axial displacement decreases toward and end of processing the workpieces, returning the tilt axis by said holding means and correspondingly decreasing the entrance displacement and exit displacement.

9. A surface grinding machine as set forth in claim 1, wherein the escape direction is generally orthogonal to a face of the grinding stones.

10. A surface grinding machine as set forth in claim 9, wherein during said axial displacement, the entrance displacement and exit displacement are of different magnitude and different direction.

11. A surface grinding machine as set forth in claim 1, wherein during said axial displacement, the entrance displacement and exit displacement are of different magnitude and different direction.

12. A surface grinding method as set forth in claim 8, wherein during said imposing, axial displacement of the grinding stones occurs in an escape direction that is generally orthogonal to a face of the grinding stones.

13. A surface grinding method as set forth in claim 12, wherein during said producing an entrance displacement and an exit displacement in the grinding stones responsive to the axial displacement, the entrance displacement and exit displacement are of different magnitude and different direction.

14. A surface grinding method as set forth in claim 8, wherein during said producing an entrance displacement and an exit displacement in the grinding stones responsive to the axial displacement, the entrance displacement and exit displacement are of different degree magnitude and different direction.

* * * * *